United States Patent [19]

Holk, Jr.

[11] 4,165,011

[45] Aug. 21, 1979

[54] BONDED CAN TOP

[75] Inventor: Albert J. Holk, Jr., Frankfort, Ill.

[73] Assignee: The Continental Group, Inc., New York, N.Y.

[21] Appl. No.: 831,981

[22] Filed: Sep. 9, 1977

[51] Int. Cl.[2] ..... B65D 7/42

[52] U.S. Cl. ..... 220/67; 220/70; 220/307; 220/359

[58] Field of Search ..... 220/66, 67, 69, 70, 220/359, 307, 254; 229/43; 113/121 C, 121 A; 215/2, 232, 341, 352

[56] References Cited

U.S. PATENT DOCUMENTS

| | | | |
|---|---|---|---|
| 282,974 | 8/1883 | Fairchild | 215/2 |
| 2,413,449 | 12/1946 | Hatch | 215/232 |
| 3,185,340 | 5/1965 | Hazelton | 220/67 |
| 3,223,063 | 12/1965 | Payton | 113/121 C |
| 3,231,152 | 1/1966 | McKiever | 220/66 |
| 3,292,828 | 12/1966 | Stuart | 220/359 |
| 3,385,470 | 5/1968 | Dorosz et al. | 220/67 |
| 3,388,824 | 6/1968 | Hazard | 220/66 |
| 3,558,036 | 1/1971 | DeVoe | 229/43 |
| 3,698,596 | 10/1972 | Potts | 220/67 |
| 3,730,383 | 5/1973 | Dunn et al. | 220/70 |
| 3,883,025 | 5/1975 | Jemmett | 215/341 |
| 3,883,034 | 5/1975 | Rausing | 220/359 |
| 3,892,351 | 7/1975 | Johnson et al. | 220/359 |
| 4,020,969 | 5/1977 | Ando | 220/359 |

FOREIGN PATENT DOCUMENTS

| | | | |
|---|---|---|---|
| 116480 | 6/1918 | United Kingdom | 215/232 |

*Primary Examiner*—Allan N. Shoap
*Attorney, Agent, or Firm*—Charles E. Brown

[57] ABSTRACT

A can which has one end thereof closed by means of a cup-shaped end unit which is provided with a band of adhesive. The band of adhesive is of sufficient width or thickness so as to receive a raw edge of a terminal end of a can body to mask the same while at the same time providing a seal between the end unit and the can body.

6 Claims, 4 Drawing Figures

FIG.1
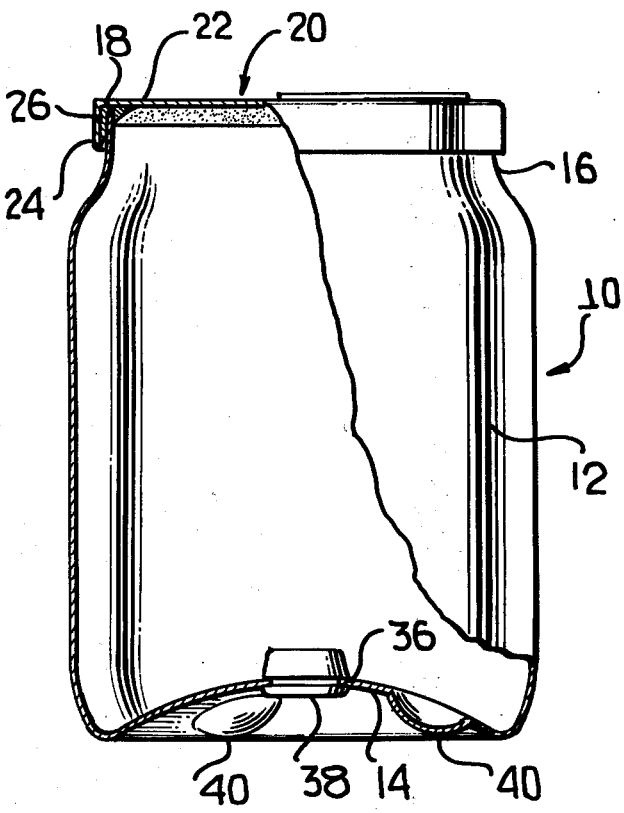
FIG.2
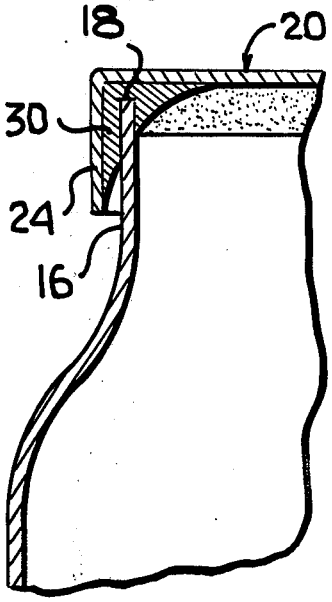
FIG.3
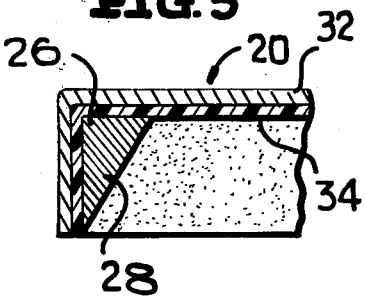
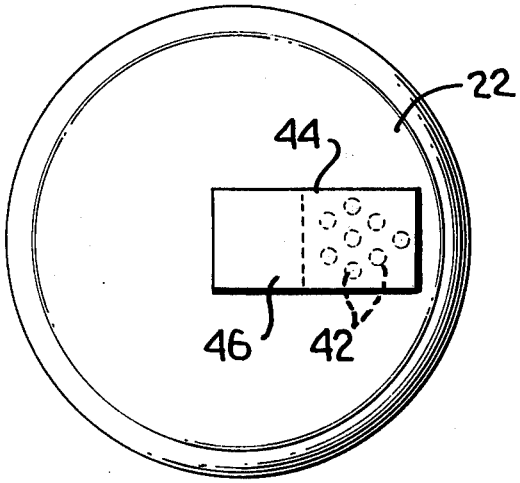
FIG.4

BONDED CAN TOP

This invention relates in general to new and useful improvements in container construction, and more particularly to a container which has an end unit adhesively bonded thereto to close one open end thereof.

It is customary for an end unit to be secured to a can body for the purpose of closing one end thereof wherein the end unit is secured in sealed relation to the can body by a double seam. Such end units require special closing machines. Further, it requires the flanging of the can bodies which in many instances results in cracking and the resultant formation of a leaky seam.

In accordance with this invention it is proposed to provide a simple connection between an end unit and the can body which eliminates the customary double seam as well as the necessary flanging of the can body. In accordance with this invention, the end unit is of a shallow cup-shaped configuration and there is provided a relatively wide or thick band of adhesive with the adhesive being such that the raw edge of the can body is embedded therein when the end unit is applied. The embedding of the raw edge of the can body in adhesive serves not only to provide the necessary seal, but also protects one against accidental contact with the raw edge.

It has also been found beneficial to utilize metal foil or metal foil laminates in the formation of the end units. Such end units can therefore be formed at a lesser cost than conventional end units.

Finally, when the end units are formed of foil or foil-laminates, the end units may be readily opened by a suitable tool, such as a conventional knife, or the end units may be of the easy opening type having preformed openings therein covered by a peelable tear strip.

The end units are particularly adaptable to two-piece containers where, due to great working and the thinning of the metal flange, cracking frequently occurs. The end units may be applied to a one-piece body and integral end prior to the filling of the can by placing a filling opening in the bottom of the can and closing the same with a suitable plug.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a vertical sectional view through a container formed in accordance with this invention.

FIG. 2 is an enlarged fragmentary vertical sectional view showing specifically the adhesive connection between the end unit and an end portion of a container body.

FIG. 3 is an enlarged fragmentary vertical sectional view taken through a corner portion of the end unit prior to application thereof to a container body, the end unit being of a slightly modified construction.

FIG. 4 is a plan view of the end unit of FIG. 1 showing a typical dispensing arrangement provided for the end unit.

Referring now to the drawings in detail, it will be seen that there is illustrated in FIG. 1 a container formed in accordance with this invention, the container being generally identified by the numeral 10. The illustrated container 10 is a two-piece container, although the invention is not intended to be so limited.

The container 10 includes a body 12 having an integral bottom end 14 with the body 12 being preferably formed by a wall ironing process. It is known that the metal of drawn and wall ironed bodies is not only quite thin but quite brittle and extreme difficulties have been experienced in attempts to flange such bodies as is necessary in the application of end units by conventional double seaming operations.

In accordance with this invention, the upper end portion 16 of the body 12 is necked-in so as to be of a slightly lesser diameter than the nominal diameter of the body 12. The necked-in end portion 16 terminates in a raw edge 18 with the terminal edge 18 being effected by a cutting operation of the shearing type.

The body 12 is closed by an end unit which is formed in accordance with this invention and is generally identified by the numeral 20. The end unit 20 is in the form of a shallow cup and includes an end wall 22 and a peripheral skirt 24 which are joined together in a peripheral corner 26.

As is best shown in FIG. 3, the end unit 20 is provided with a band 28 of adhesive which is relatively thick and which seals the peripheral corner 26. The end unit 20, when so provided, is merely telescoped over the end portion 16 with the terminal edge 18 being embedded into the adhesive 28 in the manner best shown in FIG. 2. It is to be noted that the dimension of the skirt 24 is such that there will be a band 30 of the adhesive 28 disposed between the inner surface of the skirt 24 and the exterior of the body end portion 16 so as to provide a good bond between the end unit 20 and the container body 12. Further, by making the band of adhesive 28 of sufficient width or thickness so that the entire terminal edge 18 is embedded therein, a seal will be assured while masking of the raw edge of the terminal end or edge 18 is also assured.

Inasmuch as no seaming operation is required except for the adhesive bonding, it is to be understood that the end unit 20 may be beneficially formed of thin metal on the order of foil. On the other hand, as is best shown in FIG. 3, the end unit could be formed of a foil-plastics material laminate. In FIG. 3, the foil 32 has been illustrated as being exterior of the plastics material 34, but the relative positions of the materials of the laminate could be reversed if so desired, depending upon the product which is to be packaged.

The end unit 20 may be beneficially secured to the body 12 in advance of filling so that the end unit may be applied to the body 12 in a can maker's plant. In such event filling of the can or container 10 may be effected through an opening 36 in the end 14 with the opening 36 being closed by a plug 38 which may be formed of suitable plastics material and the like.

The end 14 may be beneficially upwardly bowed as shown in FIG. 1 and may have peripherally spaced downwardly projecting bulges 40 which form feet and which provide adequate clearance for the plug 38 so that the container 10 may rest on any suitable customary supporting surface.

It is to be understood that the thinness and the nature of the material from which the end unit 20 is formed permits the end unit to be ruptured by means of a knife or like utensil whereby to facilitate the opening of the container. It is to be understood that when the container is so opened, accidental contact with the raw edge of the terminal edge 18 will be eliminated. It is also to be noted that when the materials packaged in the container 10 are of the type which would attack the metal of the body 12 if not properly coated, the embedding of the terminal edge 18 in adhesive 28 eliminates any coating problems.

It is further pointed out here with reference to FIG. 4 that when the container 10 is filled with a product which may be poured therefrom, the end unit 20 may be beneficially of the easy opening type. In such event, the end wall 22 will be provided with a preformed opening or openings 42 which define a suitable pouring means. The openings 42 will be normally sealed by a peelable tear strip 44 of a conventional type which is adhesively bonded to the upper surface of the end panel or end wall 22. The tear strip 44 will be provided with a suitable handle portion 46 to facilitate its removal.

Although the invention has been specifically illustrated and described in conjunction with a two-piece can, it is to be understood that the invention is not so limited but may be utilized in conjunction with can bodies of other constructions including those of three-piece construction wherein there are two separately formed end units. The second end units which close the body 12 remote from the end unit 20 may be secured to the body 12 in the same manner as described with respect to the end unit 20, or may be a conventional end unit secured to the body 12 by means of a conventional double seal.

It is to be understood that this invention is not restricted to any particular adhesives, although it has been found that nylon and polypropylene which are head softenable, have been found satisfactory for the purpose of bonding the end units to container bodies.

Although only a preferred embodiment of the invention has been specifically illustrated and described herein, it is to be understood that minor variations may be made in the container construction without departing from the spirit and scope of the invention as defined by the appended claims.

I claim:

1. In a container, a metal container body having an end portion terminating in a terminal cut raw edge defining an open end of said body, and an end unit closing said body open end, said end unit being cup-shaped and including a generally planar end wall and a skirt directly intersecting in a substantially right angular peripheral corner, said skirt having an internal diameter materially greater than the external diameter of said container body end portion, a continuous band of adhesive being generally triangular in cross section and being disposed on an inner surface of said skirt and extending into said peripheral corner and on a portion of said end wall, said adhesive engaging two only adjacent surfaces of said end unit, and said body end portion being telescoped within said end unit with said terminal cut raw edge being embedded in said band, and said band being of sufficient axial thickness and radial width to provide positive spacing between said body end portion and both said end unit end wall and skirt while forming a seal therebetween.

2. The container of claim 1 wherein said end unit is formed of metal foil.

3. The container of claim 1 wherein said end unit is formed of metal foil laminated to a plastics material.

4. The container of claim 1 wherein said end portion is necked-in relative to an adjacent portion of said body and said skirt lies within the outline of said body.

5. The container of claim 1 wherein said body is a drawn and wall ironed body.

6. The container of claim 1 wherein both said body end portion and said skirt are cylindrical prior to the assembly of said end unit with said container body.

* * * * *